United States Patent [19]

Clay

[11] Patent Number: 4,781,269

[45] Date of Patent: Nov. 1, 1988

[54] DESCENT REGULATOR AND ESCAPE SYSTEM

[76] Inventor: Richard B. Clay, 1134 Sonoma Ave., Santa Rosa, Calif. 95405

[21] Appl. No.: 64,172

[22] Filed: Jun. 18, 1987

[51] Int. Cl.[4] ..... A62B 1/20; A62B 1/12

[52] U.S. Cl. ..... 182/5; 182/233; 182/238; 182/71; 182/192

[58] Field of Search ..... 182/233, 5, 192, 191, 182/6, 7, 231, 236, 71, 10, 11, 238; 188/65.1–65.5

[56] References Cited

U.S. PATENT DOCUMENTS

| | | | |
|---|---|---|---|
| 285,606 | 9/1883 | Forsyth | 182/5 |
| 287,940 | 11/1883 | Johnson | 182/231 |
| 654,705 | 7/1900 | Boody | 182/236 |
| 1,500,943 | 7/1924 | Jolkovski | 182/236 |
| 4,538,704 | 9/1985 | Forrest | 182/10 |
| 4,569,417 | 2/1986 | Lee et al. | 182/5 |
| 4,674,599 | 6/1987 | Nelson | 182/6 Y |

FOREIGN PATENT DOCUMENTS

| | | | |
|---|---|---|---|
| 994304 | 8/1976 | Canada | 182/5 |
| 123540 | 9/1902 | Fed. Rep. of Germany | 182/191 |

*Primary Examiner*—Alvin C. Chin-Shue

*Attorney, Agent, or Firm*—Larry D. Johnson

[57] ABSTRACT

The invention provides an escape system that enables automatic and unmonitored lowering of a body from a building or other height. The system includes a frame portion installed in a building so that it can be placed in or moved to a window in an emergency, and includes a track or slide portion extendable through the window a short distance from the exterior surface of the building. A length of special fire-resistant cord or rope is fed from a supply reel on the frame, along the track, through the window, and to the ground below. A descent regulator device incorporating an escapement mechanism is attached to the rope, and the user is secured to the descent regulator by a harness. The user then steps (or is placed) out the window, and the descent regulator incrementally moves down the rope, serving to lower the user to the ground. Once on the ground, the descent regulator is disconnected from the rope, and the user is removed from the harness, making way for other users similarly descending the rope from above.

6 Claims, 6 Drawing Sheets

DESCENT REGULATOR AND ESCAPE SYSTEM

BACKGROUND OF THE INVENTION

1. Field of the Invention

This invention relates generally to safety systems for buildings and other user-occupied structures, and more specifically to an improved apparatus for enabling escape from such a structure.

2. Description of the Prior Art

Numerous kinds of devices and equipment have been developed to assist the occupants of a burning building or other endangered structure to escape from such danger. For example, most modern building codes require buildings to have fire escapes, emergency stairwells, and/or ladders to assist in evacuation of the building. However, it is well known that many buildings, especially highrise structures, are particularly susceptible to danger and loss of life resulting from a fire at a lower level in the building acting to cut off an escape route for those trapped higher up in the building.

Some specialized systems have been designed to address this problem by providing an emergency lowering system, such as a line or rope secured to and then thrown from the building, enabling the occupants to lower themselves or others manually down the line. Unfortunately, most of these systems require significant strength and presence of mind on the part of the users, and do not typically enable the lowering of unconscious or injured occupants.

SUMMARY OF THE INVENTION

The present invention provides a descent regulator and escape system that enables automatic and unmonitored lowering of a body from a building or other height. The system includes a frame portion installed in a building so that it can be placed in or moved to a window in an emergency, and includes a track or slide portion extendable through the window a short distance from the exterior surface of the building. A length of special fire-resistant cord or rope is fed from a supply reel on the frame, along the track, through the window, and to the ground below. A descent regulator device incorporating an escapement mechanism is attached to the rope, and the user is secured to the descent regulator by a harness. The user then steps (or is placed) out the window, and the descent regulator incrementally moves down the rope, serving to lower the user to the ground. Once on the ground, the descent regulator is disconnected from the rope, and the user is removed from the harness, making way for other users similarly descending the rope from above.

The descent regulator comprises a roller housing portion and an escapement housing portion. The roller housing contains a pair of drive rollers which, when the housing is in its open configuration, can be placed around the rope fed from the supply reel on the frame, and then can be closed together to engage the rope between them, so that the drive rollers are turned as the housing is pulled along the rope.

The two drive rollers are mechanically linked and synchronized to drive an escapement wheel in the escapement housing. The escapement wheel includes a series of sloped teeth extending radially outward from the wheel's circumference. The teeth on the escapement wheel rotate beneath and contact a pair of arbor pins mounted to opposite sides of a pivotable pallet arbor device. The teeth and arbor pins are positioned so that as one of the pins is fully extended to the peak height of one of the teeth on the wheel, the other pin is not so extended, but rather is in contact with the escapement wheel circumferential surface between adjacent teeth some distance away around the curvature of the escapement wheel. As the escapement wheel continues to be driven by the drive rollers and rotates further, the two arbor pins maintain this relative position from the escapement wheel circumferential surface, and the wheel continues to rotate until the next adjacent tooth on the wheel contacts the second, initially radially lower pin. Thus, this tooth "falls" the increment of circumferential distance to the radially lower pin, enabling the escapement wheel, and thus the drive rollers, to rotate this distance unimpeded, which translates to a linear travel of the descent regulator down the rope. At this contact with the advancing tooth, this second pin is forced up the inclined surface of the tooth, in a direction radially outward from the escapement wheel, while the first, initially-extended and radially higher pin is correspondingly caused to move radially inward back towards the escapement wheel.

The rising and falling action of the respective arbor pins from their contact with the teeth causes the pallet arbor to rock back and forth about an arbor axle, oscillating a lever arm on the opposite side of the pallet arbor from the pins. This oscillation can be mechanically, hydraulically, or otherwise dampened to control and slow the lever arm movement, thus effectively controlling the rate of descent of the descent regulator. In the preferred embodiment, the escapement movement is controlled by a closed hydraulic dampening system comprising a pair of opposed pistons attached to the arbor lever arm. Movement of the lever arm is thus dampened by the viscosity of the fluid flow between the two pistons, and can be regulated by a variable-diameter orifice placed in the fluid flow line between the pistons. Alternatively the escapement can be mechanically dampened or regulated by opposing coil springs other means.

In one version of the descent regulator, a variation in the slope of the teeth on the escapement wheel provides a safety feature to prevent free-fall of the device if the dampening system should fail. In this variation, the very base of the front surfaces of the advancing teeth are not inclined, but rather are vertical or even reverse-angled, forming notch or catch portions immediately adjacent the wheel's circumferential surface, and beneath the teeth's inclined surfaces. The geometry of the dampening system pistons and pallet arbor can be adjusted so that, as long as the dampening system is operating properly, each piston travels only far enough to enable clearance of the radially higher arbor pin over the peak of the tooth it contacts on the escapement wheel, while the radially lower arbor pin contacts the next advancing tooth at its inclined surface, above the notch portion. However, should the dampening system fail (e.g., due to loss of hydraulic fluid), the moving piston of the dampening system would not encounter resistance, and thus would travel further into an overextension position, causing the radially lower arbor pin to move yet further radially inward towards the escapement wheel, where it would contact the notch portion of the advancing tooth and stop there. Thus, the escapement wheel would be prevented from further rotation and the descent regulator would stop its descent. The user could then be manually raised or lowered up or down the rope as a fixed object. Alternatively, a more traditional braking system could be incorporated that would directly lock the escapement wheel upon any dampening system failure.

Thus, the descent regulator operates to control the rate of descent of a body down the rope. Since no user activity or control is required for the descent, an unconscious or otherwise injured body can be placed in the harness and attached to the descent regulator for evacuation without fear of an uncontrolled, dangerous descent.

BRIEF DESCRIPTION OF THE DRAWINGS

FIG. 1 is a partially cutaway perspective view of the escape system, illustrating the frame portion of the system in position against a building wall;

FIG. 2 is a partially cutaway elevated side view of the escape system, illustrating the arrangement of the frame, descent regulator, and harness portions of the system at the initiation of an occupant's descent; and FIG. 3 is a partially cutaway elevated side view of the escape system, illustrating the operation of the descent regulator and harness portions during an occupant's descent;

FIG. 4 is a view of the descent regulator portion with the roller housing in its open configuration and with a rope (indicated in phantom) being placed in it; and FIG. 5 is a view of the descent regulator portion with the roller housing in its closed and locked configuration, with the rope passing through it;

FIG. 6 is a view of the roller housing of the descent regulator in its open configuration; and FIG. 7 is a view of the roller housing of the descent regulator in its closed and locked configuration illustrating the arrangement of the drive rollers of the roller housing and the escapement mechanism of the escapement housing;

FIG. 8 is a view of the synchronizing gears when the roller housing is in its open configuration; and FIG. 9 is a view of the synchronizing gears when the roller housing is in its closed configuration;

DETAILED DESCRIPTION OF A PREFERRED EMBODIMENT

Figure 1:
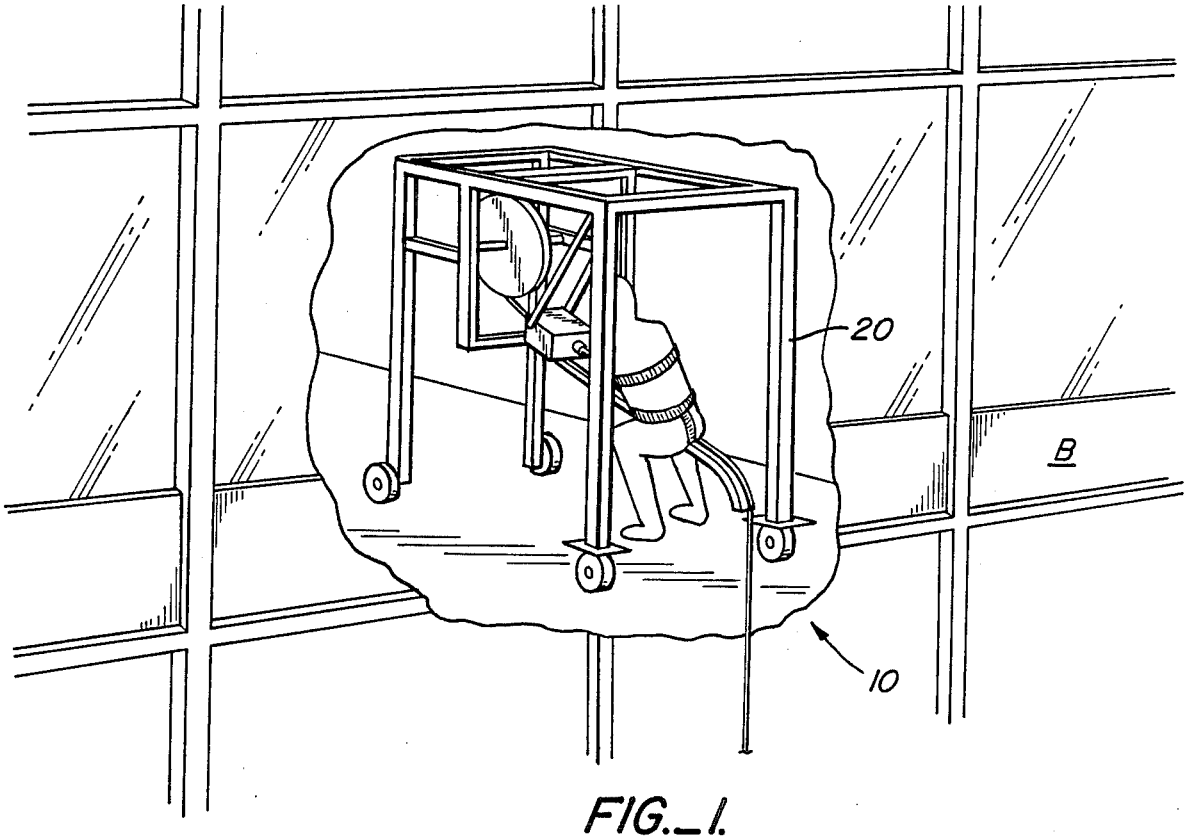
FIGS. 1–3 are a series of views of an escape system of this invention as installed in a building and in operation to enable an occupant to escape from such a building.

FIG. 1 is a partially cutaway perspective view of an escape system 10 illustrating a frame portion 20 as placed against the inside surface of an exterior wall of a building B. Frame 20 could be permanently fixed in place in a given location of a building, or be movable to be placed against any appropriate window.

Figure 2:
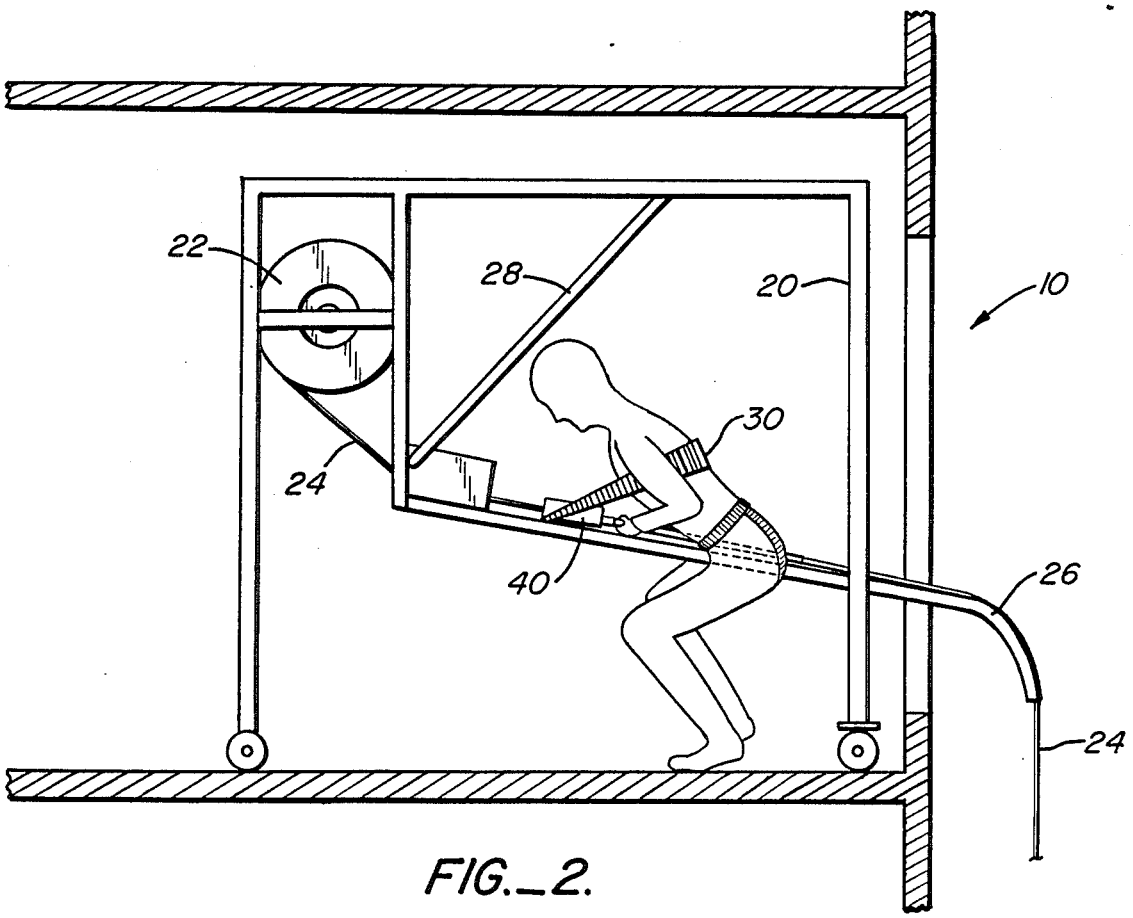

FIG. 2 is a partially cutaway elevated side view of escape system 10, illustrating the arrangement of the frame portion 20, a harness portion 30, and a descent regulator portion 40. Frame 20 includes a rope supply reel 22, from which a fireproof cord or rope 24 is dispensed through the frame down a slide or track 26 and to the ground below. Frame 20 may include a guard mechanism 28 conditioned so that if the weight on the rope exceeded a certain predetermined amount (e.g., the safe load strength of the rope), the guard would drop to a "lock-out" position, and prevent additional users from attaching to the rope until the weight on the rope was reduced (as, for example, by previous users reaching the ground and disconnecting from the system).

Figure 3:
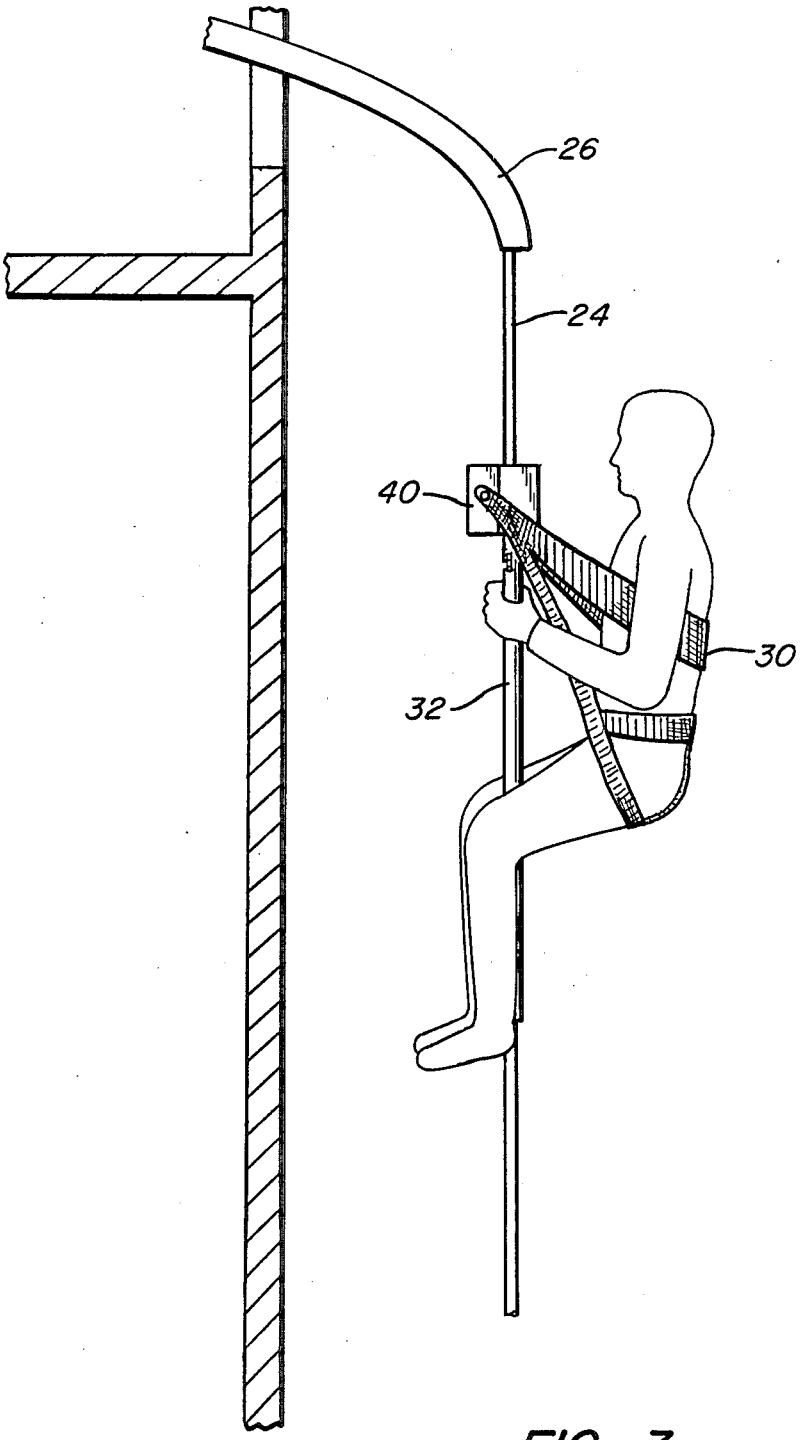

FIG. 3 is a partially cutaway elevated side view of a user descending down rope 24. Here, harness 30 is shown securely but removably connected to descent regulator 40 for the user's descent. A friction guard 32 serves to shield the descending user from abrasion against the stationary rope.

Figure 4:
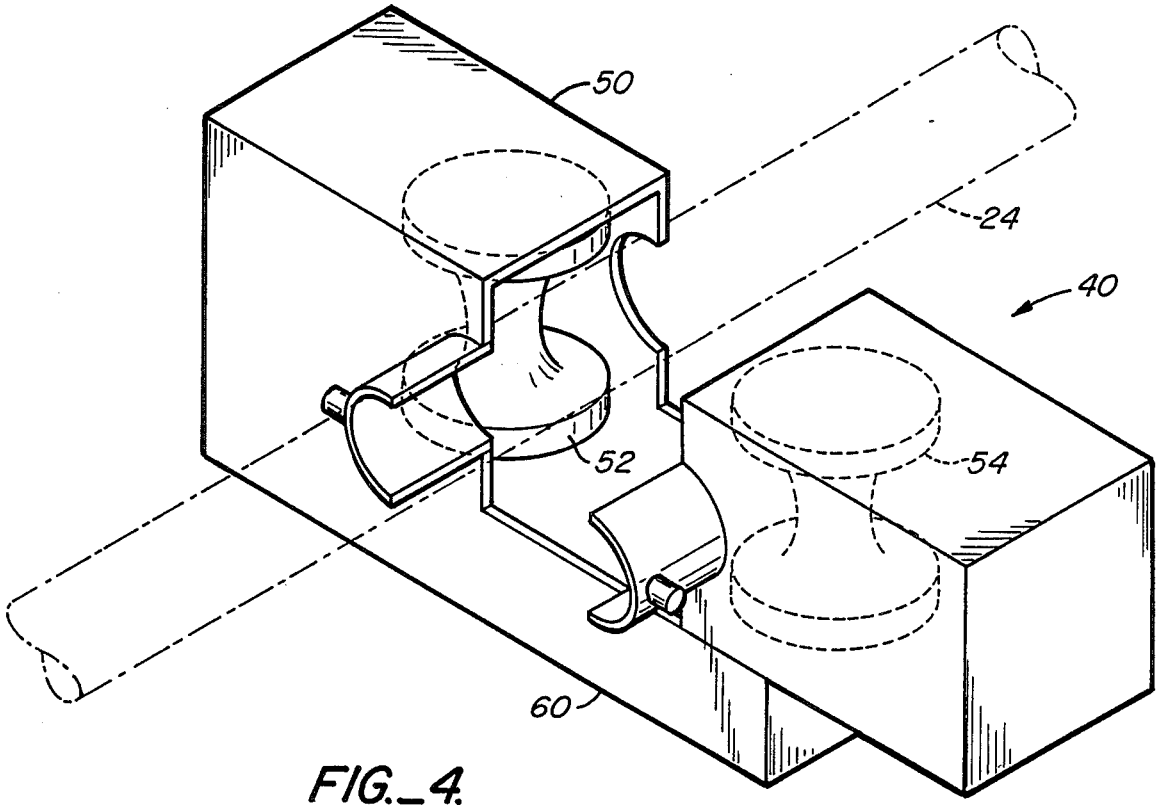
FIGS. 4 and 5 are exterior perspective views of the descent regulator portion of the escape system.

FIG. 4 is a view of descent regulator 40 with its roller housing 50 in its open configuration to accomodate placement of rope 24. Escapement housing 60, described infra, constitutes the other portion of descent regulator 40. Roller housing 50 contains a pair of drive rollers 52, 54, which engage the rope when they are brought together around it.

Figure 5:
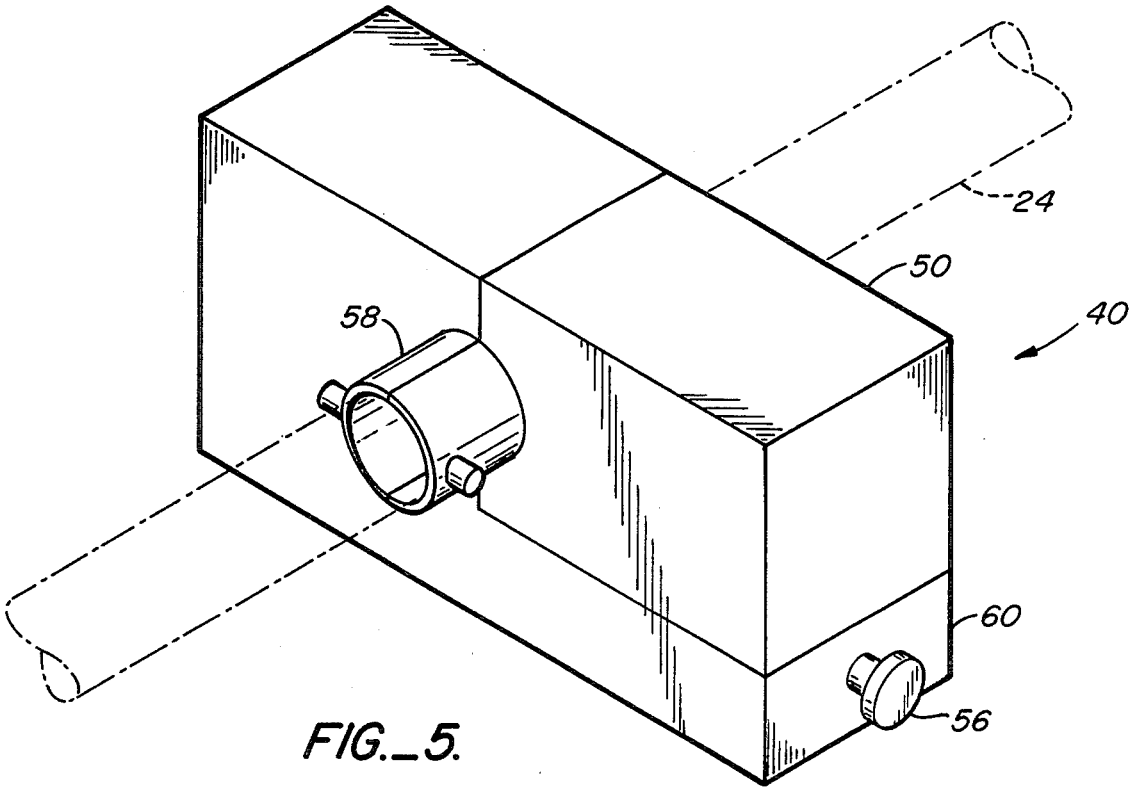

FIG. 5 is a view of descent regulator 40 with roller housing 50 in its closed and locked configuration, with rope 24 passing through the housing 50. A harness can now be secured to harness attachment 56 and a friction guard attached at friction guard attachment 58.

Figure 6:
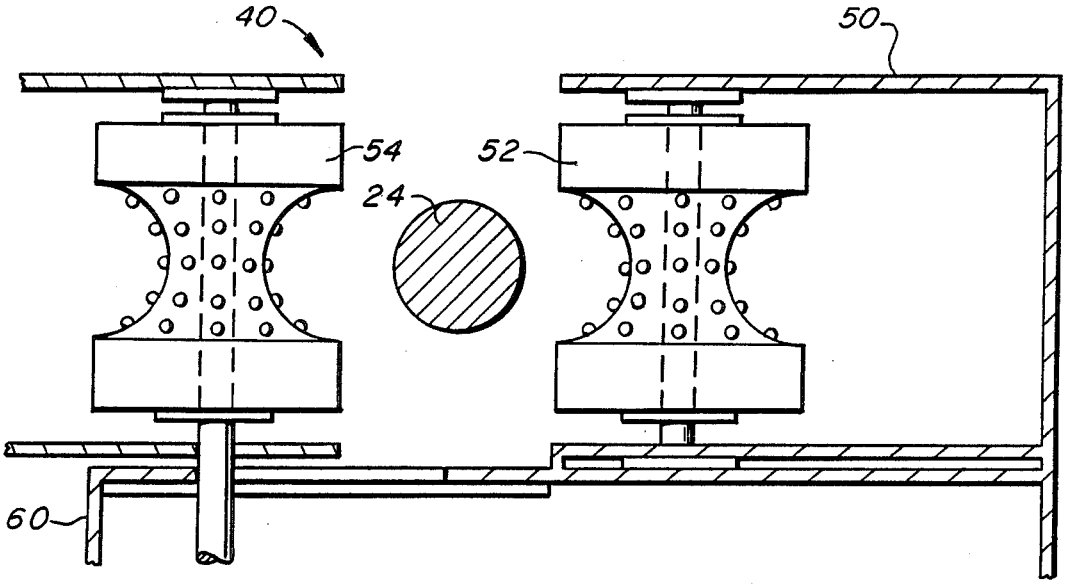
FIGS. 6 and 7 are cutaway horizontal views of the descent regulator portion of the escape system.

FIG. 6 is a cutaway horizontal view of roller housing 50 in its open configuration. Drive rollers 52, 54 can be seen to surround rope 24 so that when the rollers are brought together, the rope is securely engaged between them. The rollers may engage the rope through sheer mechanical compression, frictional engagement (e.g., with toothed rollers), or any other non-slip means.

Figure 7:
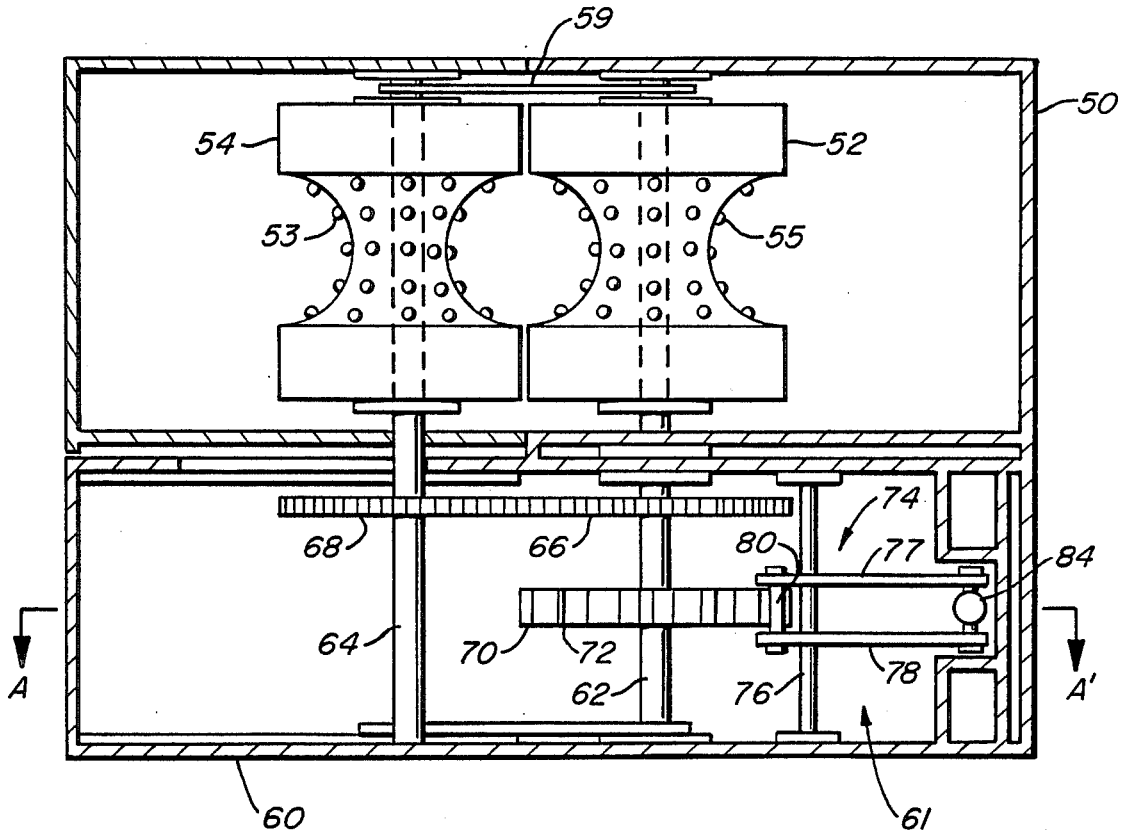

FIG. 7 is a cutaway horizontal view of descent regulator 40 in its closed and locked configuration. Here, drive rollers 52, 54 have been brought together about a rope, and locked there by latch mechanism 58. In this view, teeth 53, 55 are shown disposed about rollers 52, 54 to frictionally engage the rope captured between them.

Drive rollers 52, 54 are mechanically linked to escape mechanism 61 within escapement housing 60 by a pair of drive axles 62, 64. Rotation of these axles is synchronized by synchronizing gears 66, 68 so that both axles serve to engage the rope through their respective drive rollers, and thus drive the escapement mechanism. Drive axle 62 drives escapement wheel 70, which carries a series of inclined teeth 72 about its circumference, and rotates beneath pallet arbor device 74 pivotable about pallet arbor axle 76. Pallet arbor device 74 includes a pair of arbor plates 77, 78 which carry a pair of arbor pins 80, 82 (82 is not visible in this view) against escapement wheel 70 and teeth 72. The resultant oscillating motion of the pallet arbor device 74 is transmitted to and regulated by a dampening system 84.

Figure 8:
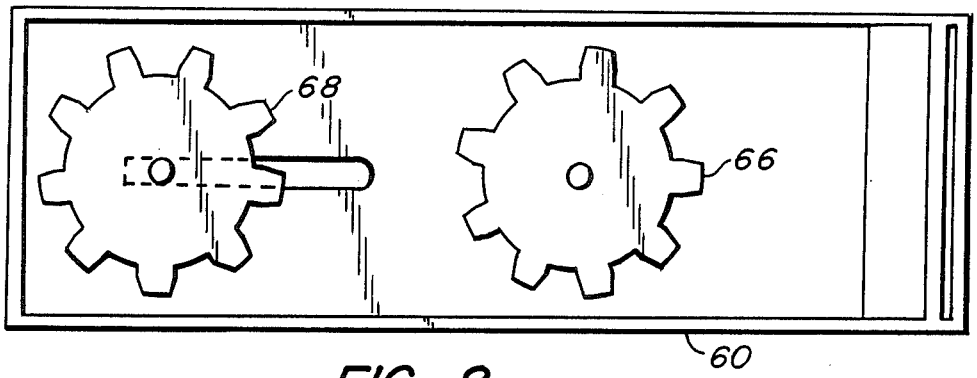
FIGS. 8 and 9 are vertical cross-sectional views of the escapement housing, illustrating the arrangement of the synchronizing gears of the escapement mechanism.

FIG. 8 is a vertical cross-sectional view of the escapement housing 60, illustrating the relation of synchronizing gears 66, 68 when the roller housing, and thus the drive rollers are in their open configuration.

Figure 9:
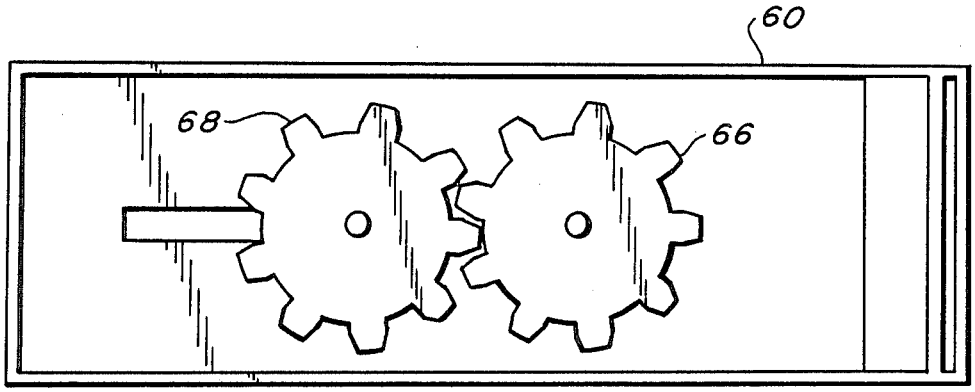

FIG. 9 is a view similar to FIG. 8, but illustrating the relation of the synchronizing gears when the roller housing, and thus the drive rollers, are brought together to their closed and locked configuration.

Figure 10:
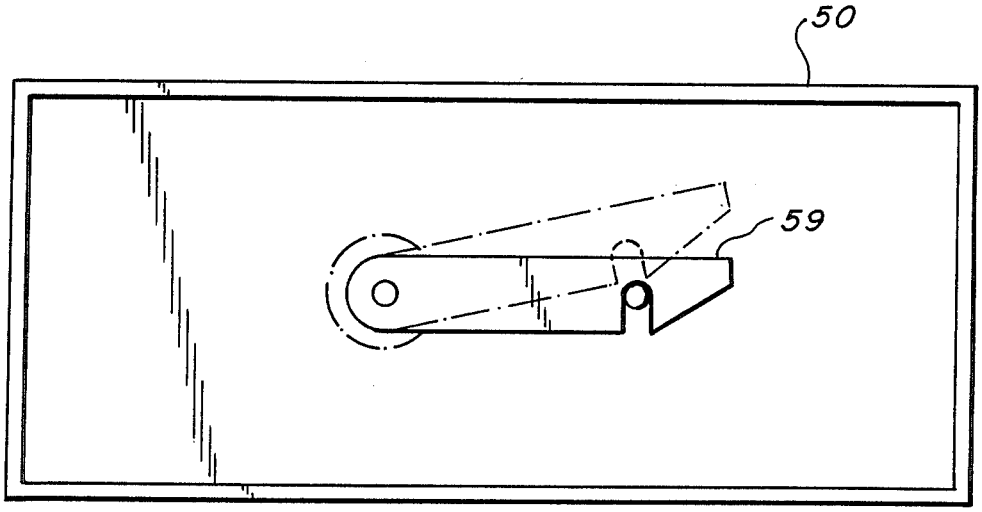
FIG. 10 is a side view of the latch mechanism of the descent regulator used to lock the roller housing in its closed and locked configuration.

FIG. 10 is a side view of latch mechanism 58 as used to lock the roller housing in its closed and locked configuration.

Figure 11:
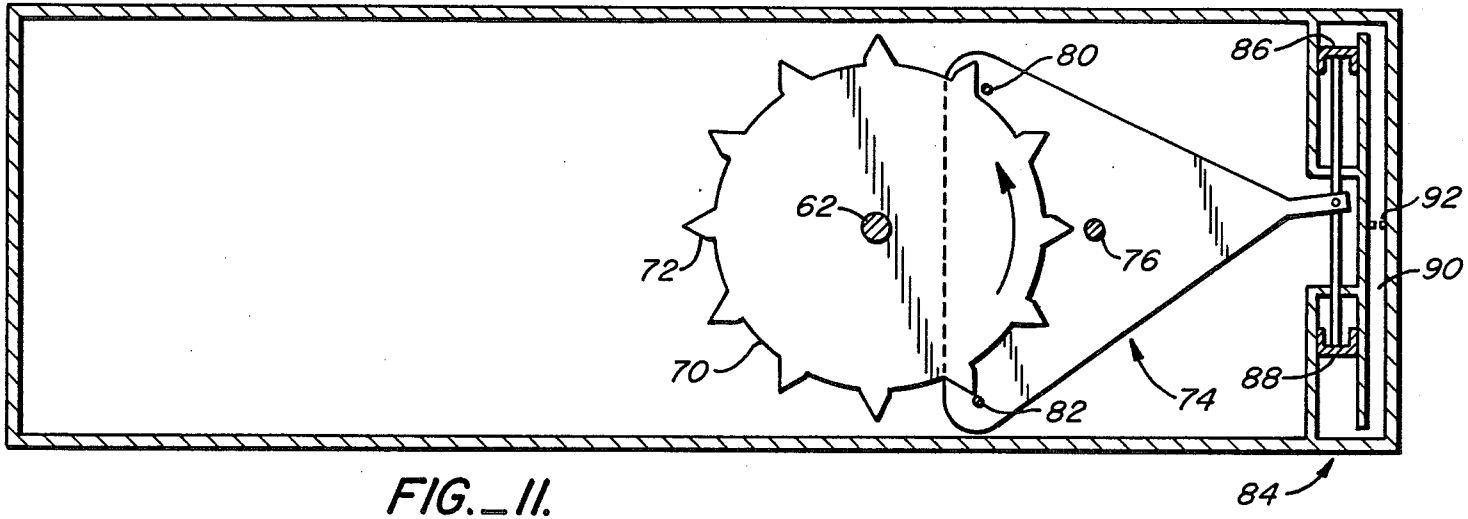
FIG. 11 is a vertical cross-sectional view taken along line A—A' of FIG. 7, illustrating the escapement mechanism and dampening system of the descent regulator.

FIG. 11 is a vertical cross-sectional view taken along line A—A′ of FIG. 7, and illustrates the escapement mechanism 61 and dampening system 84. Escapement mechanism 61 includes escapement wheel 70 rotatable about drive axle 62. Escapement wheel 70 carries a series of inclined teeth 72 about its circumference, which alternately engage and disengage pallet arbor pins 80, 82, as described. This motion causes pallet arbor device 74 to oscillate back and forth about pallet arbor axle 76, thus acting as a lever arm connected to dampening system 84. Dampening system 84 includes a pair of opposing pistons 86, 88 which force hydraulic fluid through passage 90. Resistance to this fluid flow, and thus regulation of the dampening effect, is controllable by appropriate adjustment of a variable orifice or valve 92.

Figure 12:
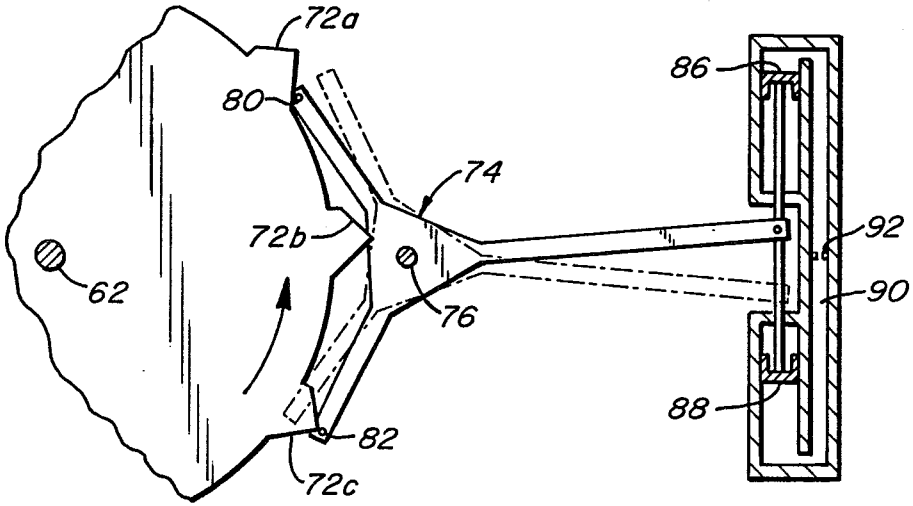
FIG. 12 is a detailed vertical cross-sectional view of the escapement mechanism and dampening system of the descent regulator illustrating the various positions of the pallet arbor when the system is operating.

FIG. 12 is a more detailed vertical cross-sectional view of the escapement mechanism and dampening system. In this view, it can seen that under normal operating conditions, the minimum radial extension of the arbor pin 82 is controlled by the resistance to full deflection or extension of piston 86. However, if the dampening system should lose its hydraulic fluid, piston 86 would be fully deflected, moving the arbor pin 80 down against the escapement wheel surface, where the pin would contact the perpendicular notch portion of the next advancing tooth 72*b*, thereby locking the escapement wheel in place and preventing free-fall of the descent regulator.

While this invention has been described in connection with preferred embodiments thereof, it is obvious that modifications and changes therein may be made by those skilled in the art to which it pertains without departing from the spirit and scope of the invention. For example, while the invention has been described for use with emergency evacuation of occupants from a building, the device could be used equally effectively for the lowering of any weight from any reasonable height, as in the lowering of a piano or other weighty object from a window. Accordingly, the scope of this invention is to be limited only by the appended claims.

What is claimed as invention is:

1. An apparatus for regulating the rate of descent of an object down a line, said apparatus comprising:

attachment means for removably securing said object to said aparatus;

drive roller means for non-slip engagement of said apparatus to said line, said drive roller having an axis, so that when said drive roller is moved along said line, said drive roller turns about said axis in rotational motion;

linkage means connected to said drive roller axis for transmission of said drive roller rotational motion;

escapement wheel means connected to said linkage means, said escapement wheel having a circumferential surface, and carrying a tooth means, said tooth means disposed radially outward from said circumferential surface;

arbor means including at least a first arbor pin and a second arbor pin, said arbor pins supported by said arbor means proximate said escapement wheel surface and said tooth means;

pivot means for enabling oscillating motion of said arbor means about an arbor pivot point;

lever arm means connected to said pivot for transmission of said arbor means oscillating motion; and dampening means comprising a closed hydraulic dampening system for regulating said lever arm motion, wherein when said apparatus is attached to and is moved along said line, said escapement wheel rotates so that said tooth means contacts and displaces said arbor pins in alternate sequence to oscillate said arbor means about said pivot.

2. The apparatus of claim 1 wherein said escapement wheel tooth means comprises at least a first tooth and a second tooth, positioned so that when said first arbor pin is in contact with said first tooth, said second arbor pin is not in contact with said second tooth, and when said second arbor pin is in contact with said second tooth, said first arbor pin is not in contact with said first tooth.

3. The apparatus of claim 1 wherein said closed hydraulic dampening system comprises a pair of opposed piston means for driving a fluid through a variable-diameter orifice.

4. The apparatus of claim 1 wherein said attachment means comprises a harness, said drive roller means comprises a pair of toothed rollers conditioned to surround and capture said line in frictional engagement, said dampening means comprises a pair of opposed pistons driving a fluid through a variable-diameter orifice, and further including a frame means for supporting said line from a building.

5. The apparatus of claim 1 wherein said tooth means comprises a plurality of teeth disposed about said circumferential surface, each of said teeth having a front surface inclined generally away from the direction of escapement wheel rotation, and at least one tooth having a notch portion below said inclined surface, so that when said teeth contact one of said arbor pins at said inclined surfaces, said arbor pin is displaced and said escapement wheel is allowed to rotate, but when said notch portion contacts one of said arbor pins, said arbor pin is not displaced and said escapement wheel is not allowed to rotate.

6. The apparatus of claim 5 wherein said dampening means has a first condition and a second condition, and operates to position said arbor pins for contact with said teeth at said inclined surfaces when said dampening means is in said first condition, and to position said arbor pins for contact with said teeth at said notch portion when said dampening system is in said second condition.

* * * * *